United States Patent [19]

Lee

[11] Patent Number: 4,937,401

[45] Date of Patent: Jun. 26, 1990

[54] SIGNAL CABLE ASSEMBLY INCLUDING BUNDLES OF WIRE STRANDS OF DIFFERENT GAUGES

[76] Inventor: Noel Lee, 47 W. Park Dr., Daly City, Calif. 94015

[21] Appl. No.: 293,685

[22] Filed: Jan. 5, 1989

[51] Int. Cl.[5] ..... H01B 7/08

[52] U.S. Cl. ..... 174/117 F; 174/113 C; 174/115; 174/131 A

[58] Field of Search ..... 174/113 C, 131 A, 115, 174/117 R, 117 F, 128.1

[56] References Cited

U.S. PATENT DOCUMENTS

| | | | |
|---|---|---|---|
| 2,014,214 | 9/1935 | Smith | 174/34 |
| 2,193,429 | 3/1940 | McConnell | 174/131 A |
| 2,216,340 | 10/1940 | Elliott | 174/103 |
| 2,286,827 | 6/1942 | Morrison | 174/115 |
| 2,302,839 | 11/1942 | Burgett | 174/113 C |
| 2,309,439 | 1/1943 | Burgett | 174/113 C |
| 2,455,773 | 12/1948 | Johnson | 174/117 R |
| 2,509,894 | 5/1950 | Toulmin et al. | 174/128 R |
| 2,581,472 | 1/1952 | Dudley et al. | 174/117 F |
| 2,584,027 | 1/1952 | Kendrick | 174/113 C |
| 2,658,014 | 11/1953 | Morrison | 174/113 R |
| 2,953,627 | 9/1960 | Malnefitch et al. | 174/102 R |
| 2,998,840 | 9/1961 | Davis | 174/113 C |
| 3,032,604 | 5/1962 | Timmons | 174/115 |
| 3,211,821 | 10/1965 | Wakefield | 174/26 R |
| 3,291,891 | 12/1966 | Sharp | 174/36 |
| 3,324,233 | 6/1967 | Bryant | 174/131 R |
| 3,355,544 | 11/1967 | Costley et al. | 174/106 R |
| 3,413,799 | 12/1968 | LeJeune | 57/217 |
| 3,465,092 | 9/1969 | Schwartz | 174/78 |
| 3,584,139 | 6/1971 | Swanson | 174/103 |
| 3,602,632 | 8/1971 | Ollis | 174/36 |
| 3,624,276 | 11/1971 | Rawlins et al. | 174/129 R |
| 3,634,607 | 1/1972 | Coleman | 174/113 R X |
| 3,644,659 | 2/1972 | Campbell | 174/36 X |
| 3,772,454 | 11/1973 | Donecker et al. | 174/113 R |
| 3,773,109 | 11/1973 | Eberline | 174/115 X |
| 3,784,732 | 1/1974 | Whitfill | 174/108 |
| 3,789,130 | 1/1974 | Parker | 174/115 |
| 3,816,644 | 6/1974 | Giffel et al. | 174/115 |
| 4,025,715 | 5/1977 | Foley et al. | 174/36 |
| 4,028,660 | 6/1977 | Pitts, Jr. | 174/115 X |
| 4,358,636 | 11/1982 | Ijff et al. | 174/103 |
| 4,449,012 | 5/1984 | Voser | 174/117 F X |
| 4,461,923 | 7/1984 | Bogese | 174/36 |
| 4,486,623 | 12/1984 | Ploppa | 174/113 R |
| 4,538,023 | 8/1985 | Brisson | 174/115 |
| 4,677,256 | 6/1987 | Bauer et al. | 174/116 |
| 4,731,506 | 3/1988 | Lee | 174/117 F X |
| 4,734,544 | 3/1988 | Lee | 174/117 F |
| 4,743,712 | 5/1988 | Lee | 174/113 C |
| 4,767,890 | 8/1988 | Magnan | 174/115 X |
| 4,777,324 | 10/1988 | Lee | 174/115 X |

FOREIGN PATENT DOCUMENTS

| | | | |
|---|---|---|---|
| 1465554 | 8/1964 | Fed. Rep. of Germany . | |
| 2900302 | 5/1979 | Fed. Rep. of Germany . | |
| 1472221 | 1/1967 | France . | |
| 1377922 | 2/1988 | U.S.S.R. | 174/113 C |

*Primary Examiner*—Morris H. Nimmo
*Attorney, Agent, or Firm*—Warren B. Kice

[57] ABSTRACT

A cable assembly formed by a plurality of bundles of twisted wire strands with the wire strands forming at least one bundle being of a different gauge than the wire strands forming at least one other bundle. Insulation means extend around the bundles of wire strands. A pair of cables configured in the above manner are provided to carry the positive and negative signals between a power source and a load.

15 Claims, 2 Drawing Sheets

SIGNAL CABLE ASSEMBLY INCLUDING BUNDLES OF WIRE STRANDS OF DIFFERENT GAUGES

BACKGROUND OF THE INVENTION

This invention relates to a cable assembly, and, more particularly, to a cable assembly for transmitting an electrical signal between a power source and a load.

Various types of cables have been used to transfer electrical current, in some form of signal, between a power source and a load. For example, the signal from an audio amplifier is transmitted by a cable to a loudspeaker for producing a replica of a signal from a program source that is introduced to the amplifier. However, there is much controversy as to the optimum type of cable that should be used in this environment.

SUMMARY OF THE INVENTION

It is an object of the present invention to provide a signal cable assembly in which a plurality of bundles of twisted wire strands are provided which carry the signal.

It is a further object of the present invention to provide a cable assembly of the above type in which the bundles of wire strands are twisted relative to each other.

It is a further object of the present invention to provide a cable assembly of the above type in which the wire strands forming one bundle are of a different gauge than the wire strands forming another bundle.

Toward the fulfillment of these and other objects, the cable of the present invention includes a plurality of bundles of twisted wire strands. The bundles are twisted and are disposed within an insulation and the wire strands of the respective bundles are of different gauges.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention which taken in conjunction with the accompanying drawings wherein.

DESCRIPTION OF THE PREFERRED EMBODIMENT

Figure 1:
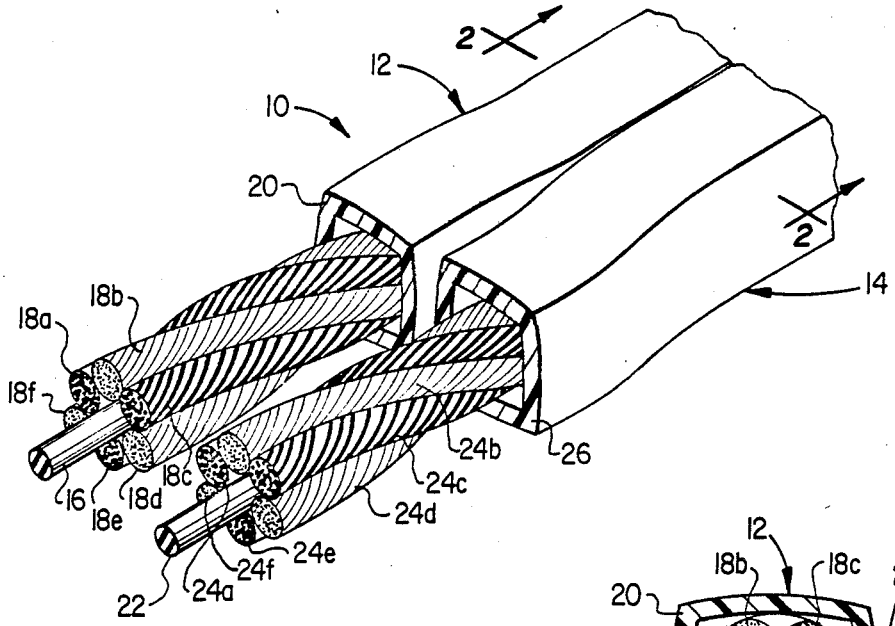
FIG. 1 is a partial perspective view depicting a signal cable of the present invention, with the insulation portion of the cable being removed from the end portions thereof for convenience of presentation.
Figure 2:
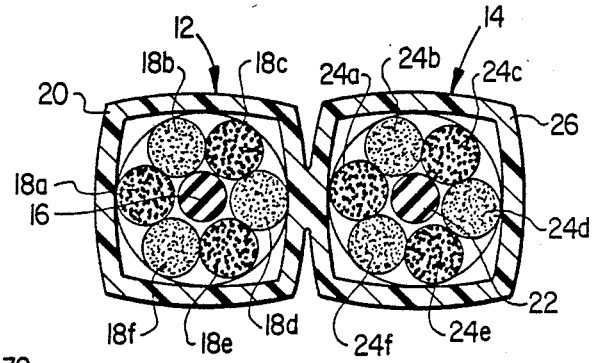
FIG. 2 is a cross-sectional view taken along the line 2—2 of FIG. 1.
Figure 3:
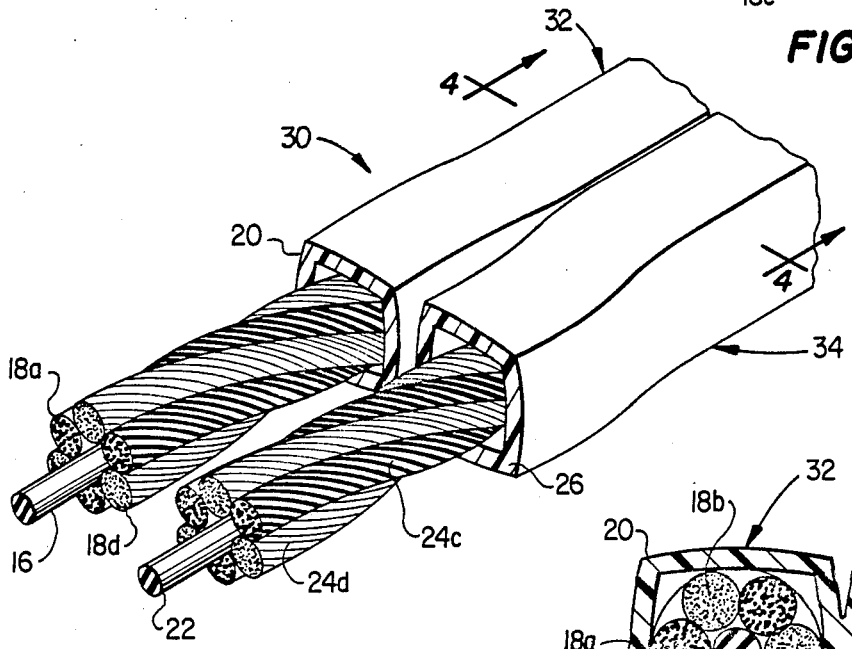
FIGS. 3 and 5 are views similar to FIG. 1, but depicting alternate embodiments of the cable assembly of the present invention.
Figure 4:
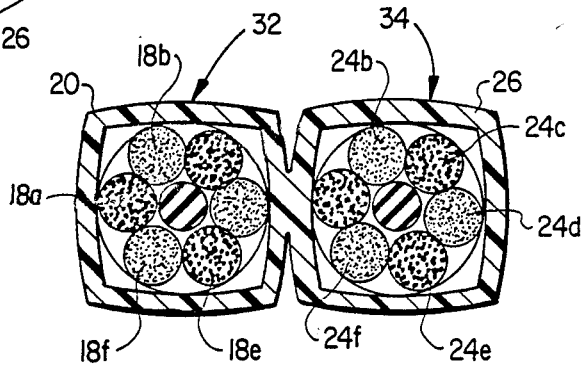
FIGS. 4 and 6 are cross-sectional views taken along the lines 4—4 and 6—6, of FIGS. 3 and 5, respectively.

Referring specifically to FIGS. 1 and 2 of the drawings the reference numeral 10 refers in general to the signal cable assembly of the present invention which comprises a first cable 12 extending in a juxtaposed, parallel relationship to a second cable 14.

The cable 12 is formed by a central, solid, rod like dielectric core 16 surrounded by six bundles 18*a*, 18*b*, 18*c*, 18*d*, 18*e* and 18*f* of wire strands. The bundles 18*a*–18*f* are twisted about the core 16 and, as shown by the curved lines, the wire strands forming each bundle are twisted in a direction opposite that of the direction of twist of the bundles.

According to a feature of the present invention, the wire strands forming the bundles 18*a*, 18*c* and 18*e* are of a larger diameter, or smaller gauge, than the wire strands forming the bundles 18*b*, 18*d* and 18*f*. For example, the wire strands forming the bundles 18*a*, 18*c* and 18*e* can be of a 30 gauge (AWG) while the wire strands forming the bundles 18*b*, 18*d* and 18*f* can be of a 36 gauge.

An insulating sleeve 20 extends around the bundles 18*a*–18*f*. is fabricated of an insulating material such as plastic or rubber, and has a substantially rectangular cross section. The end portion of the sleeve 20 has been deleted from the drawing and the length of the core 16 has been extended, for the convenience of presentation.

The cable 14 is identical to the cable 12 and, as such, includes a dielectric core 22 which is surrounded by a plurality of bundles 24*a*, 24*b*, 24*c*, 24*d*, 24*e* and 24*f* of wire strands. The bundles 24*a*–24*f* are twisted around the core 22 in a direction opposite to that of the twist of the wire strands forming each bundle. The bundles 24*a*, 24*c* and 24*e* are of a 30 gauge while the wire strands forming the bundles 24*b*, 24*d* and 24*f* are of a 36 gauge. An insulating sleeve 26 extends around the twisted bundles 24*a*–24*f*.

The cores 16 and 22 are fabricated from a dielectric material such as polypropylene and the wire strands forming the bundles 18*a*–18*f* and 24*a*–24*f* are of a current carrying material, such as copper. Each bundle 18*a*–18*f* and 24*a*–24*f* consists of approximately forty-eight stands. As shown in FIG. 2 the sleeves 20 and 26 are disposed in a juxtaposed parallel relationship with their corresponding sidewall portions being molded together.

In use the respective uninsulated end portions of each cable 12 and 14 are connected as a single unit between a power source and/or load. One of the cables 12 or 14 can carry the positive signal and the other can carry the negative signal with the respective uninsulated ends of each cable being connected, via conventional connectors, such as spade lugs, banana plugs, or the like, to the positive and negative terminals of the power source and load. The bundles 18*a*–18*f* thus together function as one conductor and the bundles 24*a*–24*f* function together as one conductor, it being understood that, since the dielectric cores 16 and 22 are nonconductive they are not connected to the power source or load.

As an alternative embodiment, in order to reduce costs the dielectric cores 16 and 22 can be replaced by a wire or conductor surrounded by insulation and nonterminated as discussed above.

The cable assemblies of the embodiments of FIGS. 3–7 contain structure identical to the structure of the embodiment of FIGS. 1 and 2 which structure is given the same reference numerals. According to the embodiment of FIGS. 3 and 4, a cable assembly 30 is provided which consists of two cables 32 and 34. The latter cables are identical to the cables 12 and 14, respectively, with the exception that the bundles 18*a*–18*f* of the cable 32 and the bundles 24*a*–24*f* of the cable 34 are twisted about the cores 16 and 22, respectively, and, as shown by the curved lines, the wire strands forming each bundle are twisted in the same direction as the direction of twist of the bundles.

Figure 5:
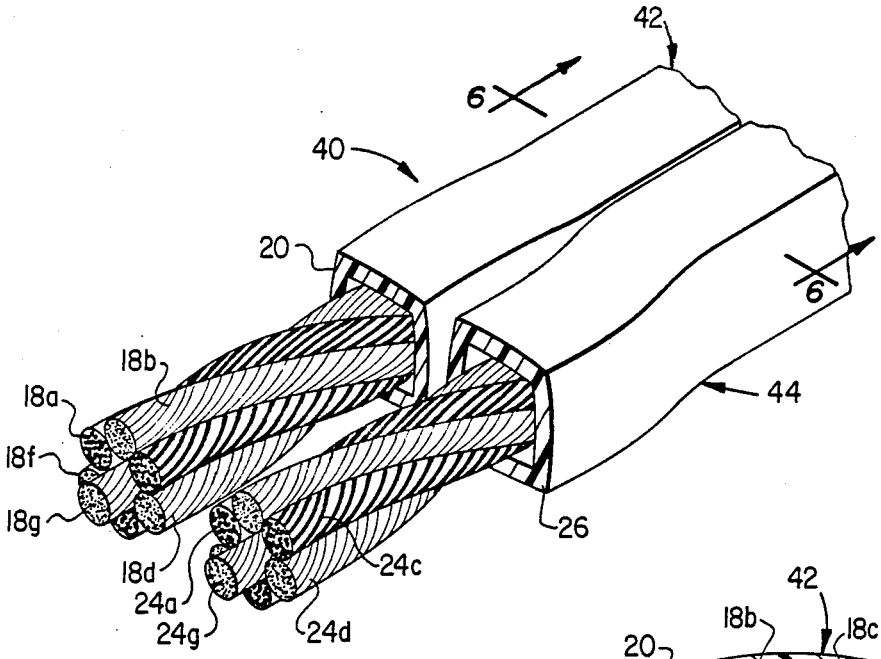
Figure 6:
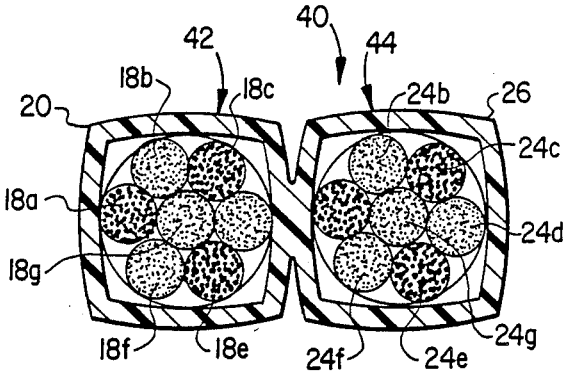

According to the embodiment of FIGS. 5 and 6 a cable assembly 40 is provided which consists of two cables 42 and 44 which are identical to the cables 12 and 14, respectively, of FIGS. 1 and 2 with the exception that the dielectric cores 16 and 22 of the cables 12 and 14, respectively, are each replaced by an additional bundle of wire strands. More particularly, in the cable 42 a bundle **18*g* of wire strands is disposed in the center portion of the cable and the bundles 18*a*–18*f* are twisted about the bundle 18*g*. As shown by the curved lines, the wire strands forming each bundle are twisted in a direction opposite that of the direction of twist of the bundles. The wire strands forming the bundle 18*g* are of the same gauge as the wire strands forming the bundles 18*b*, 18*d* and 18*f* and therefore are smaller in diameter than the strands forming the bundles 18*a*, 18*c* and 18*e*. The cable 44 of the embodiment is identical to cable 42 and, as such, includes a bundle 24*g* disposed in the center portion of the cable and surrounded by the bundles 24*a*–24*f***.

Figure 7:
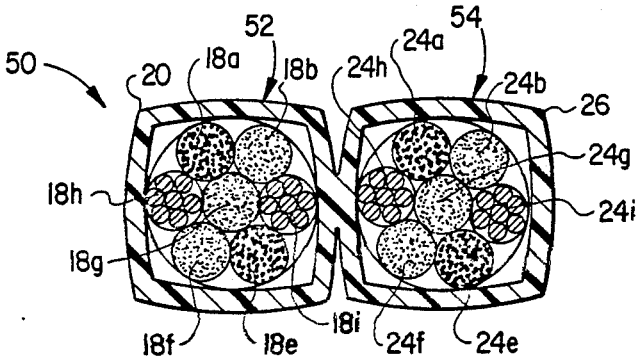
FIG. 7 is a view similar to FIG. 6 but depicting another alternate embodiment of the cable assembly of the present invention.

According to the embodiment of FIG. 7, a cable assembly 50 is provided which consists of cables 52 and 54. The cable 52 includes bundles **18*a* and 18*e* of wire strands of a relative large diameter and bundles 18*b*, 18*f* and 18*g* of wire strands of a relatively small diameter as in the previous embodiments. According to a feature of the embodiment FIG. 7, two additional bundles 18*h* and 18*i* are provided which are of a larger diameter, or smaller gauge, than the bundles 18*a* and 18*e*. For example, the bundles 18*h* and 18*i* can be of a 24 gauge. The bundles 18*a*–18*f*, 18*h* and 18*i* can be twisted around the bundle 18*g*** in a direction opposite to that of the twist of the wire strands forming each bundle, or in the same direction as the twist of the latter wire strands.

The cable 54 is identical to cable 52 and therefore includes additional bundles **24*h* and 24*i* of wire strands of a relatively large (24 gauge) diameter. Otherwise, the cable assembly 50 is identical to the cable assembly 10 of FIGS. 1 and 2**.

Several advantages result from each of the foregoing embodiments. For example, the bundles of the larger size wire strands can better accommodate relatively low frequency signals while the smaller size wire strands of the other bundles can better accommodate relatively high frequency signals. Also, a cable is provided which is flexible, easy to handle and install.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. A signal cable assembly comprising a pair of cables adapted to respectively carry the positive and negative signals between a power source and a load, each cable comprising an elongated, rod-like solid dielectric core, a plurality of bundles of wire strands twisted around said core, the wire strands forming at least one bundle being of a different gauge than the wire strands forming at least one other bundle, and insulation means extending around said bundles of each cable.

2. The cable assembly of claim 1 wherein the wire strands forming each bundle are twisted in a direction opposite the twist of the bundles.

3. The cable assembly of claim 1 wherein the wire strands forming each bundle are twisted in the same direction as the bundles.

4. The cable assembly of claim 1 wherein there are three bundles of wire strands of a relatively small diameter and three bundles of wire strands of a relatively large diameter in each cable.

5. The cable assembly of claim 1 wherein, in each cable, the wire strands forming at least one bundle are of a different gauge than the wire strands forming at least one other bundle.

6. A signal cable assembly comprising a pair of cables adapted to respectively carry the positive and negative signals between a power source and a load, each cable comprising a center bundle of wire strands, a plurality of bundles of wire strands twisted around said center bundle, the wire strands forming at least one of said twisted bundles being of a different gauge than the wire strands forming at least one other of said twisted bundles, and insulation means extending around said twisted bundles of each cable.

7. The cable assembly of claim 6 wherein the wire strands forming each bundle are twisted in a direction opposite the twist of said twisted bundles.

8. The cable assembly of claim 6 wherein the wire strands forming each bundle are twisted in the same direction as said twisted bundles.

9. The cable assembly of claim 6 wherein there are three twisted bundles of wire strands of a relatively small diameter and three twisted bundles of wire strands of a relatively large diameter.

10. The cable assembly of claim 9 wherein the wire strands of said center bundle are of the same diameter as said relatively small diameter wire strands.

11. The cable assembly of claim 6 wherein there are at least one twisted bundle of wire strands of a relatively small diameter, at least one twisted bundle of wire strands of a relatively large diameter and at least one twisted bundle of wire strands of an intermediate diameter.

12. The cable assembly of claim 6 wherein each cable comprises three bundles of wire strands of a relatively small diameter and three bundles of a relatively large diameter surrounding said center bundle.

13. The cable assembly of claim 12 wherein the wire strands of said center bundle are of a relatively small diameter.

14. The cable assembly of claim 6 wherein in each cable there is at least one bundle of wire strands of a relatively small diameter, at least one bundle of wire strands of a relatively large diameter and at least one bundle of wire strands of an intermediate diameter.

15. The cable assembly of claim 6 wherein each cable comprises a center bundle surrounded by two bundles of wire strands of a relatively small diameter, two bundles of wire strands of a relatively large diameter, and two bundles of wire strands of an intermediate diameter.

* * * * *